US010099470B2

(12) United States Patent
Wientjes

(10) Patent No.: US 10,099,470 B2
(45) Date of Patent: Oct. 16, 2018

(54) MANDREL FOR PRINTING APPARATUS, PRINTING CYLINDER AND PRINTING APPARATUS

(71) Applicant: MPS Holding B.V., Arnhem (NL)

(72) Inventor: Hendrikus Theodorus Gerardus Wientjes, Arnhem (NL)

(73) Assignee: MPS HOLDING B.V., Arnhem (NL)

( * ) Notice: Subject to any disclaimer, the term of this patent is extended or adjusted under 35 U.S.C. 154(b) by 1 day.

(21) Appl. No.: 15/504,724

(22) PCT Filed: Mar. 29, 2016

(86) PCT No.: PCT/NL2016/050211
§ 371 (c)(1),
(2) Date: Feb. 17, 2017

(87) PCT Pub. No.: WO2016/159764
PCT Pub. Date: Oct. 6, 2016

(65) Prior Publication Data

US 2017/0274640 A1 Sep. 28, 2017

(30) Foreign Application Priority Data

Mar. 27, 2015 (NL) ..... 2014544

(51) Int. Cl.
*B41F 13/26* (2006.01)
*B41F 13/44* (2006.01)
(Continued)

(52) U.S. Cl.
CPC ..... *B41F 7/04* (2013.01); *B41F 5/24* (2013.01); *B41F 13/008* (2013.01);
(Continued)

(58) Field of Classification Search
CPC .. B41F 7/04; B41F 5/24; B41F 13/008; B41F 27/105; B41F 30/00; B41F 30/02;
(Continued)

(56) References Cited

U.S. PATENT DOCUMENTS 2,987,994 A 6/1961 Allison
3,598,050 A 8/1971 Thompson
(Continued)

FOREIGN PATENT DOCUMENTS

DE 41 06 062 C1 6/1992
DE 44 47 124 C1 2/1996
(Continued)

*Primary Examiner* — David Banh
(74) *Attorney, Agent, or Firm* — Birch, Stewart, Kolasch & Birch, LLP

(57) ABSTRACT

A mandrel for use in a printing apparatus includes a substantially cylindrical mandrel shaft and plastic expansion rings that are slidably and coaxially mounted on the mandrel shaft. The mandrel also includes a locking assembly including a fixed stop ring and a single locking ring that is axially movably mounted on the mandrel shaft. The expansion rings are positioned between the stop ring and the locking ring. In the unlocked position of the locking ring the expansion rings are in a released state in which the axial compression and the radial expansion of the expansion rings are smaller than in a locked position of the locking ring. A printing cylinder sleeve can be fixedly connected to the mandrel by bringing the expansion rings in the radially expanded state. When the printing cylinder sleeve has to be exchanged, this is feasible when the expansion rings are in the released state.

28 Claims, 7 Drawing Sheets

(51) Int. Cl.

| | |
|---|---|
| ***B41F 7/04*** | (2006.01) |
| ***B41F 5/24*** | (2006.01) |
| ***B41F 13/008*** | (2006.01) |
| ***B41F 27/10*** | (2006.01) |
| ***B41F 30/00*** | (2006.01) |
| *B41F 30/02* | (2006.01) |
| *B41F 30/04* | (2006.01) |

(52) U.S. Cl.
CPC ..... *B41F 27/105* (2013.01); *B41F 30/00* (2013.01); *B41F 30/02* (2013.01); *B41F 30/04* (2013.01); *B41P 2227/20* (2013.01); *B41P 2227/21* (2013.01)

(58) Field of Classification Search
CPC ..... B41F 30/04; B41F 27/14; B41F 13/44; B41P 2227/20; B41P 2227/21
See application file for complete search history.

(56) References Cited

U.S. PATENT DOCUMENTS

| | | | | |
|---|---|---|---|---|
| 5,168,808 | A | 12/1992 | Prem | |
| 5,522,785 | A * | 6/1996 | Kedl | B65H 23/0216 226/174 |
| 5,570,634 | A | 11/1996 | Harter | |
| 8,075,465 | B2 * | 12/2011 | Verfaellie | D21G 1/0293 492/21 |
| 2005/0069353 | A1 * | 3/2005 | Nagy | B41F 27/105 399/330 |
| 2009/0031910 | A1 | 2/2009 | Simon | |
| 2011/0011286 | A1 * | 1/2011 | Strasser | B31F 1/07 101/23 |
| 2013/0284037 | A1 * | 10/2013 | Rossini | B41F 27/105 101/216 |
| 2013/0284038 | A1 * | 10/2013 | Rossini | B41F 27/105 101/382.1 |
| 2014/0311368 | A1 | 10/2014 | Rossini | |
| 2017/0217156 | A1 * | 8/2017 | Puig Vil | B41F 30/02 |

FOREIGN PATENT DOCUMENTS

| | | | |
|---|---|---|---|
| EP | 1 164 011 | A2 | 12/2001 |
| EP | 1 679 189 | A1 | 7/2006 |
| WO | WO 01/70505 | A2 | 9/2001 |
| WO | WO 2006/114534 | A2 | 11/2006 |
| WO | WO 2008/025804 | A2 | 3/2008 |

* cited by examiner

MANDREL FOR PRINTING APPARATUS, PRINTING CYLINDER AND PRINTING APPARATUS

FIELD

The invention relates to a mandrel, as well as a sleeve type printing cylinder with such a mandrel for use in a printing apparatus. The invention also relates to a printing machine comprising such a sleeve type printing cylinder and to a method for printing.

BACKGROUND

The use of printing cylinders comprising a mandrel and a printing sleeve are known from the art, for example, for flexographic or (lithographic) off-set printing. Generally, the mandrel is an air mandrel that comprises a rigid cylindrical body, such as a steel shaft, on which a printing sleeve is removably mounted. The cylindrical surface of the air mandrel contains outflow openings via which air can be supplied when a sleeve has to be mounted on the mandrel or removed from the mandrel. A variety of printing sleeves with different radii can be mounted to provide the printing cylinder diameter required for a printing job. The image to be printed is provided directly on the printing sleeve or may be provided on a (flexible) printing plate or mold that is mounted on the printing sleeve using techniques known from the art.

Mounting the printing sleeve on the mandrel is often performed using compressed air. The printing sleeve is a substantially cylindrical body having a through hole with an inner diameter that is slightly smaller than the outer diameter of the mandrel. This allows the printing sleeve to fit with a press fit or interference fit on the mandrel. The printing sleeve further comprises at least one radially deformable or radially compressible layer that enables an inner surface of the printing sleeve to expand radially outwardly under pressure, for example by using compressed air. The printing sleeve is positioned in line with the mandrel, after which compressed air is supplied via the outflow openings provided in the cylindrical outer surface of the mandrel. The compressed air causes a radially outward expansion of the inner surface of the printing sleeve, therewith increasing its inner diameter. The increase in inner diameter is sufficient to slide the printing sleeve over the mandrel. Upon ending the supply of compressed air, the printing sleeve inner surface shrinks to provide the interference fit or press fit between the inner cylindrical surface of the sleeve and the outer cylindrical surface of the mandrel.

The precision of the known printing sleeves should be improved to obtain a more consistent and accurate printing result. The precision of a printing cylinder or printing sleeve can be indicated by a parameter called the total indicated run out value or TIR-value. The higher the TIR-value, the lower the precision. In fact, the TIR-value is an indication of the margin within which the outer cylinder surface may extend around the theoretically desired diameter of the outer surface. In other words, the TIR-value is an indication of the tolerance which is defined by the difference between the minimum and maximum diameter around a theoretically desired diameter. The smaller this margin, the smaller the TIR-value and the better the precision of the printing cylinder or printing sleeve. Part of the problems of the imperfect precision of the known printing sleeves is caused by the radially compressible layer that is present in the printing sleeve and that is needed to be able to mount the known sleeve on the air mandrel. As a result, the outer surface of printing sleeve may displace with respect to the central axis of the air mandrel. This causes a deviation which is reflected by an increase of the TIR-value of the printing cylinder. As explained above, higher TIR-value corresponds with a larger deformation and, as a result, with a lower print quality. Another disadvantage of the sleeves having an compressible inner layer is that such sleeves have a limited life time in view of the deterioration of the compressible inner layer.

US 2014/0311368 discloses an air-mountable printing sleeve for mounting on a mandrel, wherein the printing sleeve is a multi-layered cylindrical sleeve provided with at least two rigid radial spacer members that substantially replace the deformable layers. The printing sleeve comprises an inner layer and an outer layer that are connected by two rigid, circular spacer members disposed at the opposite extreme ends of the printing sleeve. The inner layer comprises a deformable material that is radially expandable or radially deformable. The inner surface of the inner layer has an inner diameter that is slightly smaller than the outer diameter of a mandrel, which inner diameter can be increased using for example compressed air. This allows the printing sleeve to be mounted on the mandrel with an interference fit. The outer layer of the printing sleeve is made of a material that is rigid and non-expandable by compressed air. The outer layer is fixedly connected with at least two rigid spacer members comprising annular rings that extend radially and circumferentially in an empty space between the inner layer and the outer layer. The outer annular surface of each extreme end of the inner layer is fixedly connected to the inner annular surface of a corresponding end spacer member. The end spacer members connect the inner layer and the outer layer. Any spacer members not disposed on the extreme outer ends of the printing sleeve are separated from the inner layer with a gap between the inner surface of the spacer members and the outer surface of the inner layer. The gap is very small, for example in the order of fractions of a millimeter. The gap allows the expansion and shrinkage of the inner layer required for mounting the printing sleeve to the mandrel.

A disadvantage of the printing sleeve according to US 2014/0311368 is that the gap between the spacer members and the inner layer of the printing sleeve allow vibration and deformation of the printing sleeve, thus reducing the TIR-value and the print quality. Furthermore, the inner layer and the outer layer of the printing sleeve are only connected to each other on the opposite extreme ends of the printing sleeve, which is a disadvantage, especially in printing sleeves with a greater length.

This problem has been recognized in WO2006114534 of which the US-equivalent is US2009031910 and which represents the closest prior art. This publication discloses a printing shaft assembly on which a metal printing sleeve can be mounted. The connection between the metal printing sleeve and the shaft assembly is effected by metal washers of which the radially outer ends are inclined relative to a plane that extends perpendicular to the axis of the shaft assembly. By virtue of a clamping force exerted in the axial direction on the metal washers, the radial outer ends are deformed so that the washers become more flat and obtain an increased outer diameter. The outer circumferential edge of the radially outer ends thus engages the inner surface of the printing sleeve and performs a clamping action. The publication discloses two sets of washers disposed at the two axial extremities of the shaft assembly and the sleeve cooperating therewith. The contact surface between the washers and the sleeve is very small and compressing the washers requires a complicated control assembly including a control shaft that is axially moveably arranged in a support shaft of the shaft assembly, transmission rings and cotter pins that pass through the transmission rings, the support shaft and the control shaft. The transmission rings and cotter pins are provided adjacent both axial extremities of the support shaft and the control shaft extends over the entire length of the support shaft through the support shaft. This complicated control assembly is necessary for compressing the two sets of washers to the substantially same extend when clamping between the support shaft and the printing sleeve is needed. Consequently, the shaft assembly known from WO2006114534 and US2009031910 is beneficial in that it provides the possibility to use an exchangeable metal printing sleeve. However, the clamping force that may be obtained with the axially compressible washers is limited and the construction for the compression of the washers is complicated.

SUMMARY

The object of this invention is to provide a mandrel for use in a printing apparatus that substantially removes the disadvantages associated with the use of an air mandrel and a deformable printing sleeve and the disadvantages of the shaft assembly of US2009031910 while maintaining the possibility of using a metal or otherwise non-deformable printing sleeves.

To that end, the invention provides a mandrel according to claim 1. for use in a printing apparatus. The mandrel comprises:

- a substantially cylindrical mandrel shaft extending along a mandrel shaft axis, characterized in that the mandrel additionally comprises:
- a plurality of expansion rings that are slidably and coaxially mounted on the mandrel shaft, wherein the expansion rings are radially outwardly expanded when axially compressed;
- a locking assembly, comprising:
  - a stop ring that has an axially fixed position on the mandrel shaft adjacent a first end of the mandrel shaft;
  - a locking ring that is movably mounted on the mandrel shaft adjacent a second end of the mandrel shaft;

wherein the expansion rings are mounted between the stop ring and the locking ring, and wherein the locking assembly has a locked position in which the locking ring is positioned closer to the stop ring than in an unlocked position, wherein in the locked position the expansion rings are in an axially compressed and radially expanded state, and wherein in the unlocked position the expansion rings are in a released state in which the axial compression and the radial expansion of the expansion rings are smaller than in the locked position, wherein the outer diameter of the expansion rings is larger in the locked position than in the unlocked position of the locking assembly, The mandrel is characterized in that the locking assembly comprises just a single stop ring and a single locking ring, wherein the mandrel additionally includes:

- a plurality of spacer rings that are coaxially mounted on the mandrel shaft in between the expansion rings, such that the expansion rings are spatially separated from each other, wherein the outer diameter of the spacer rings is substantially equal to the outer diameter of the expansion rings in the released state, wherein the locking ring and the stop ring are substantially equidistant from a center plane that is positioned perpendicular to the mandrel shaft axis and intersects with the mandrel shaft, wherein the plurality of expansion rings is mounted substantially symmetrically with respect to the center plane, wherein the expansion rings are made from plastic.

The mandrel according to the invention substantially removes the disadvantages of deformable printing sleeves by providing a locking assembly for connecting the mandrel and the printing sleeve. As a result, a rigid, non-deformable printing sleeve can be mounted on the mandrel. The deformation of the printing cylinder is therewith substantially prevented and an improved total indicated run out (TIR) can be achieved. This in turn provides a better print quality even at high throughput speeds. Moreover, by using the mandrel according to the invention, the printing sleeve will be internally supported by the mandrel along the entire axial length of the sleeve. By virtue of the fact that the expansion rings are spaced from one another by the plurality of spacer rings that are intermittently interposed between the expansion rings, the press fit connection between the expansion rings and the sleeve will be provided at multiple points along the axial length so that a secure connection between the mandrel and the sleeve is guaranteed. The plastic expansion rings each have a width in the range of 4-20 mm. Consequently, the circumferential surface of the expansion rings that abuts against the inner surface of a sleeve is relatively large. By virtue of this large contact surface a very strong press fit connection is obtained when the expansion rings are in the expanded state. This is contrast to the metal washers which only have a very small contact surface that engages the inner surface of the sleeve. The mandrel according to the invention obviates the use of compressed air to mount the printing sleeve, as the printing sleeve can be mounted and subsequently locked by bringing the expansion rings in an axially compressed and radially expanded state using the locking ring. The solid and rigid printing cylinder sleeve that may be used may have a much longer life time than the deformable sleeves used with the conventional air mandrels. Surprisingly, it has been found that actuating just a single locking ring still leads to a substantially equal radial expansion of each individual expansion ring when the expansion rings are made of plastic. Test with polyurethane expansion rings have provided very good results. Consequently, the clamping forces exerted by each expansion ring are substantially the same which is good for obtaining a solid connection between the sleeve and the mandrel at multiple axial positions along the length of the sleeve. Actuating just a single locking ring can be effected with a much less complicated construction than the control assembly disclosed in US2009031910. Finally, an expansion ring may be easily replaced when necessary, for example, when the life time of the expansion ring has been reached or when a printing cylinder sleeve with a different internal diameter has to be mounted on the mandrel. Normally, the printing cylinder sleeves for a respective printing apparatus all have the same internal diameter but may have different outer diameters in order to be able to create images of different printing lengths. However, it may be possible that the same type of mandrel can be fitted in printing apparatuses of different types and that for the one type printing apparatus the printing cylinder sleeves have a different internal diameter than for another type printing apparatus. This difference can be accommodated by replacing the expansion rings and the spacer rings having a first diameter with expansion rings and spacer rings having a second diameter. The cylindrical mandrel shaft of the mandrel may thus be usable in variable types of printing apparatuses.

The invention also provides a printing cylinder for use in a printing apparatus, comprising:

a mandrel according to the invention; and a cylindrical printing cylinder sleeve that is slidably mountable on the mandrel when the locking assembly is in an unlocked position, and wherein the expansion rings are in engagement with the inner surface of the printing sleeve when the locking assembly is in the locked position, such that the printing sleeve and the mandrel are fixedly connected.

The printing cylinder according to the invention has the advantage that a non-deformable, rigid printing cylinder sleeve can be used that, during use, is fixedly connected to the mandrel and supported on along substantially the entire axial length of the printing cylinder sleeve. The press fit connection will be effected at multiple points along the axial length of the printing cylinder sleeve. Therewith, deformation of the printing cylinder sleeve is substantially prevented and a printing cylinder of the sleeve type is obtained that can have a very small TIR-value because of the absence of any compressible mounting layer within the printing cylinder sleeve. Also, the printing cylinder according to the invention obviates the use of compressed air for mounting the printing cylinder sleeve, which provides a relatively simple the construction of the printing cylinder and reduces costs. Further, the use of the locking assembly having a locking ring allows a rapid exchange of the printing sleeves, which may be also at least partially automated. Finally, the solid and rigid printing cylinder sleeve that may be used may have a much longer life time than the deformable sleeves used with the conventional air mandrels. Preferably, the internal diameter of the sleeve is substantially the same as the outer diameter of the spacer rings so that the sleeve can be slidingly mounted over the spacer rings and the expansion rings when the locking assembly is in the unlocked position. By virtue of the matching inner diameter of the sleeve and outer diameter of the spacer rings, the coaxial position of the sleeve relative to the mandrel is guaranteed both in the locked position as well as in the unlocked position of the locking assembly.

The invention furthermore provides a printing apparatus for printing on a substrate web, the printing apparatus comprising at least one printing module, wherein each printing module includes:

a printing cylinder according to the invention, configured for transferring ink to a substrate web;

a drive motor or a drive transmission for rotatably driving the printing cylinder an impression cylinder that extends parallel to the printing cylinder and over which the substrate web is guided;

an ink delivery assembly for applying ink on the printing cylinder wherein the printing apparatus includes an electronic controller for controlling the at least one drive motor.

A printing apparatus according to the invention has the advantage that the printing cylinder is non-deformable due to the use of a rigid printing sleeve mounted on a mandrel having a plurality of plastic expansion rings and a plurality of spacer rings that are intermittently mounted in between the expansion rings on the mandrel shaft. As a result, the printing cylinder has a low TIR-value that leads to a higher quality printed images. Additionally, the rigid printing cylinder sleeve that may be used may have a much longer life time than the deformable sleeves used with the conventional air mandrels. Furthermore, placing and removing the printing sleeves from the mandrel is relatively easy and can be executed in a short period, which increases productivity. The printing apparatus according to the invention may be used for various types of printing processes. Furthermore, the construction of the printing cylinder obviates the use of compressed air, allowing a more simple construction for the apparatus.

The invention additionally comprises a method for printing using a printing apparatus, wherein the method comprises:

providing a printing apparatus according to the invention;

bringing the locking assembly to an unlocked position;

sliding the printing cylinder sleeve over the mandrel;

locking the locking assembly, therewith bringing the expansion elements in contact with the inner surface of the printing sleeve, thus connecting the printing sleeve and the mandrel;

providing a web substrate and printing images on said web substrate using said printing cylinder sleeve.

The method according to the invention has several advantages over the prior art. First of all, mounting and removing the printing sleeves is relatively easy due to the simple construction of the locking assembly. In addition, the printing sleeve and mandrel used in the method are rigid in nature, which prevents deformation during printing. The printed images will therefore have a higher quality.

Various embodiments are claimed in the dependent claims, which will be further elucidated with reference to some examples shown in the figures. The embodiments may be combined or may be applied separate from each other.

DETAILED DESCRIPTION

In this application similar or corresponding features are denoted by similar of corresponding reference signs. The description of the various embodiments is not limited to the examples shown in the figures and the reference numbers used in the detailed description and the claims are not intended to limit the description of the embodiments. The reference numbers are included to elucidate the embodiments by referring to the examples shown in the figures.

Figure 1:
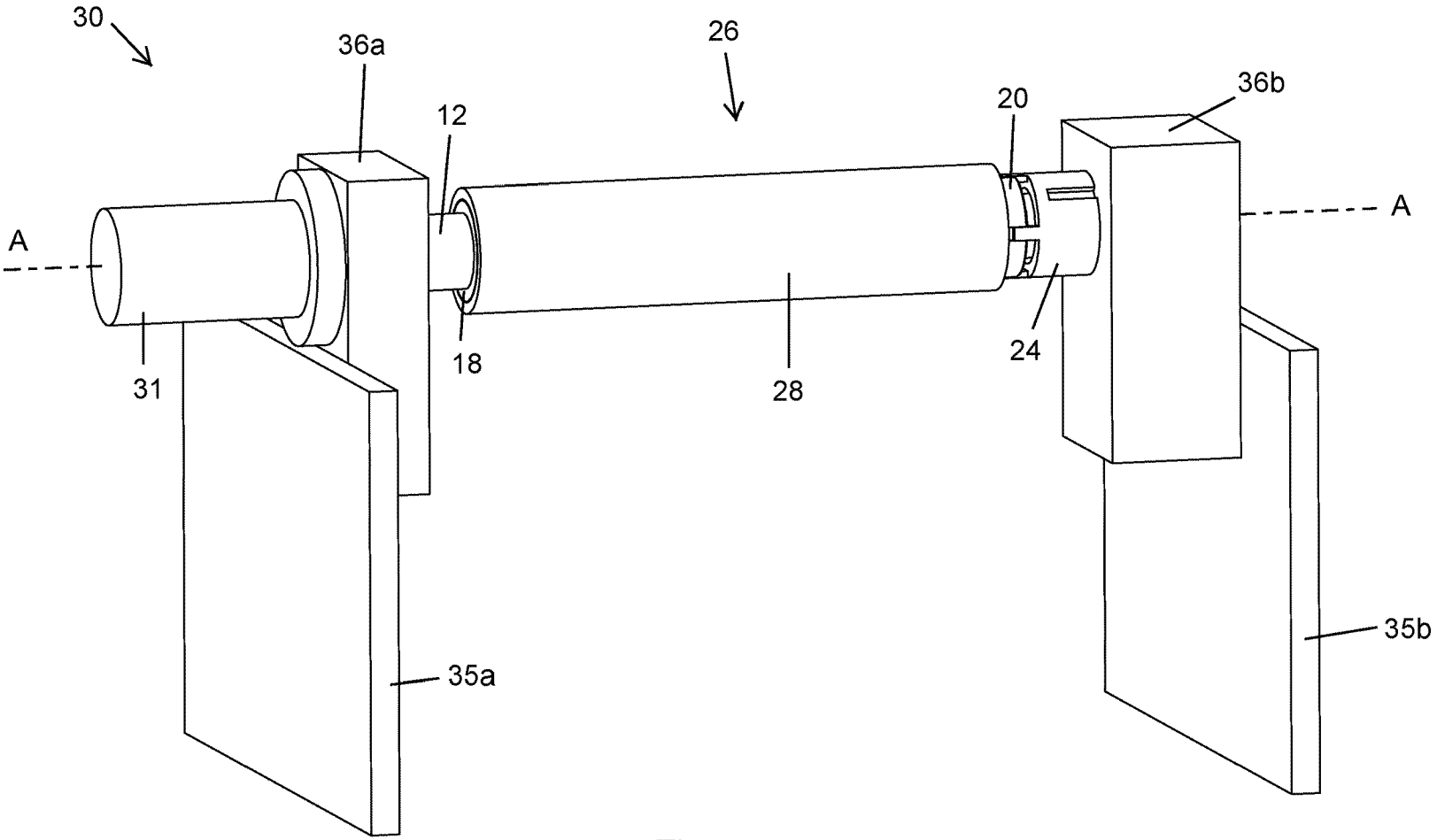
FIG. 1 shows a perspective view of the relevant part an example of a printing apparatus according to the invention with a tool in the engaged position.
Figure 2:
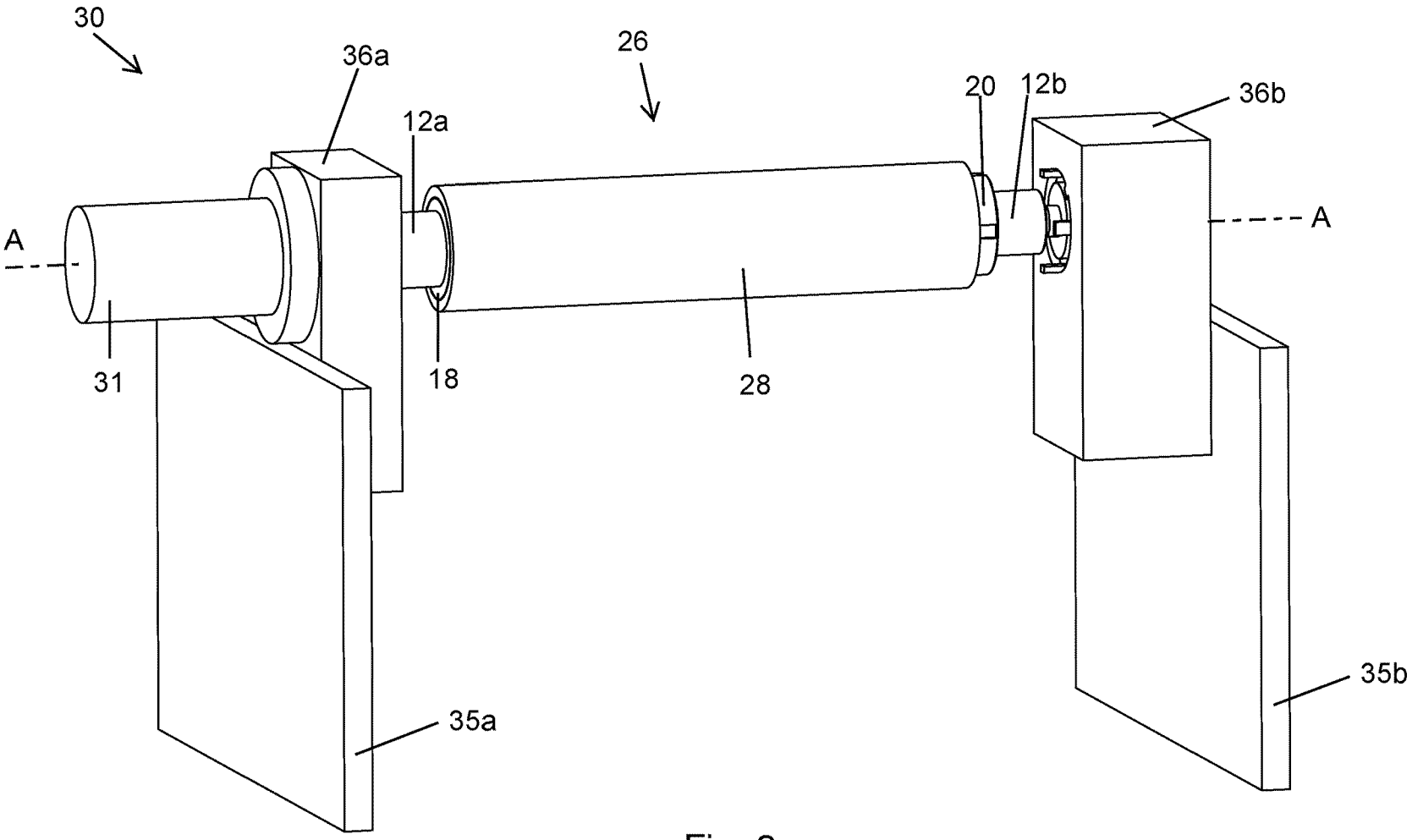
FIG. 2 shows the printing apparatus of FIG. 1 with the tool in disengaged position.
Figure 3:
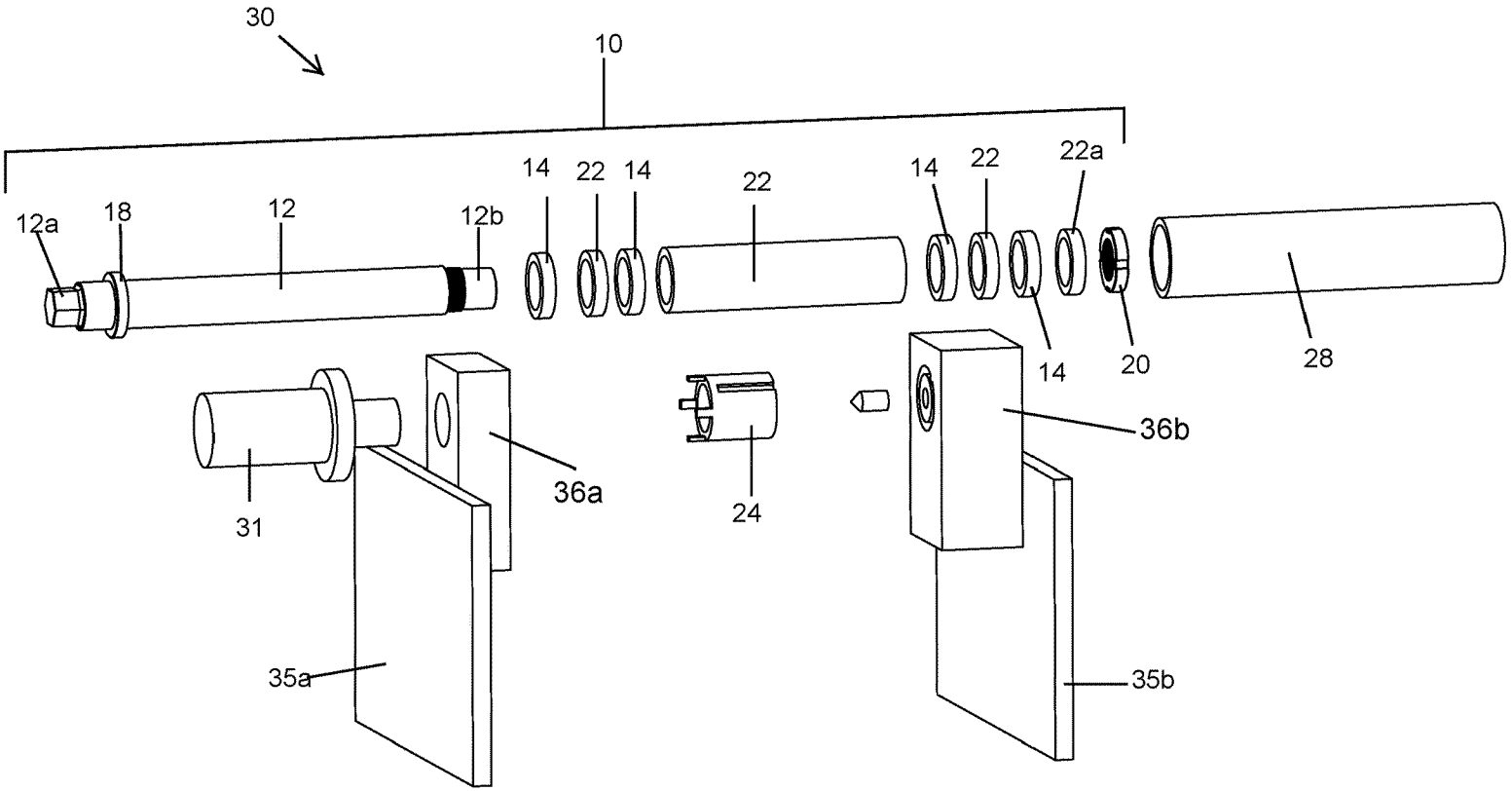
FIG. 3 shows an exploded view of the apparatus of FIG. 1.
Figure 4:
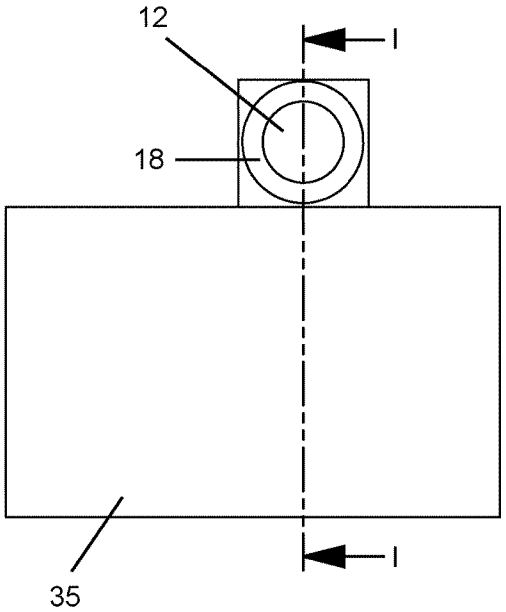
FIG. 4 shows a schematic view of drive side of the relevant part the printing apparatus of FIG. 1.
Figure 5:
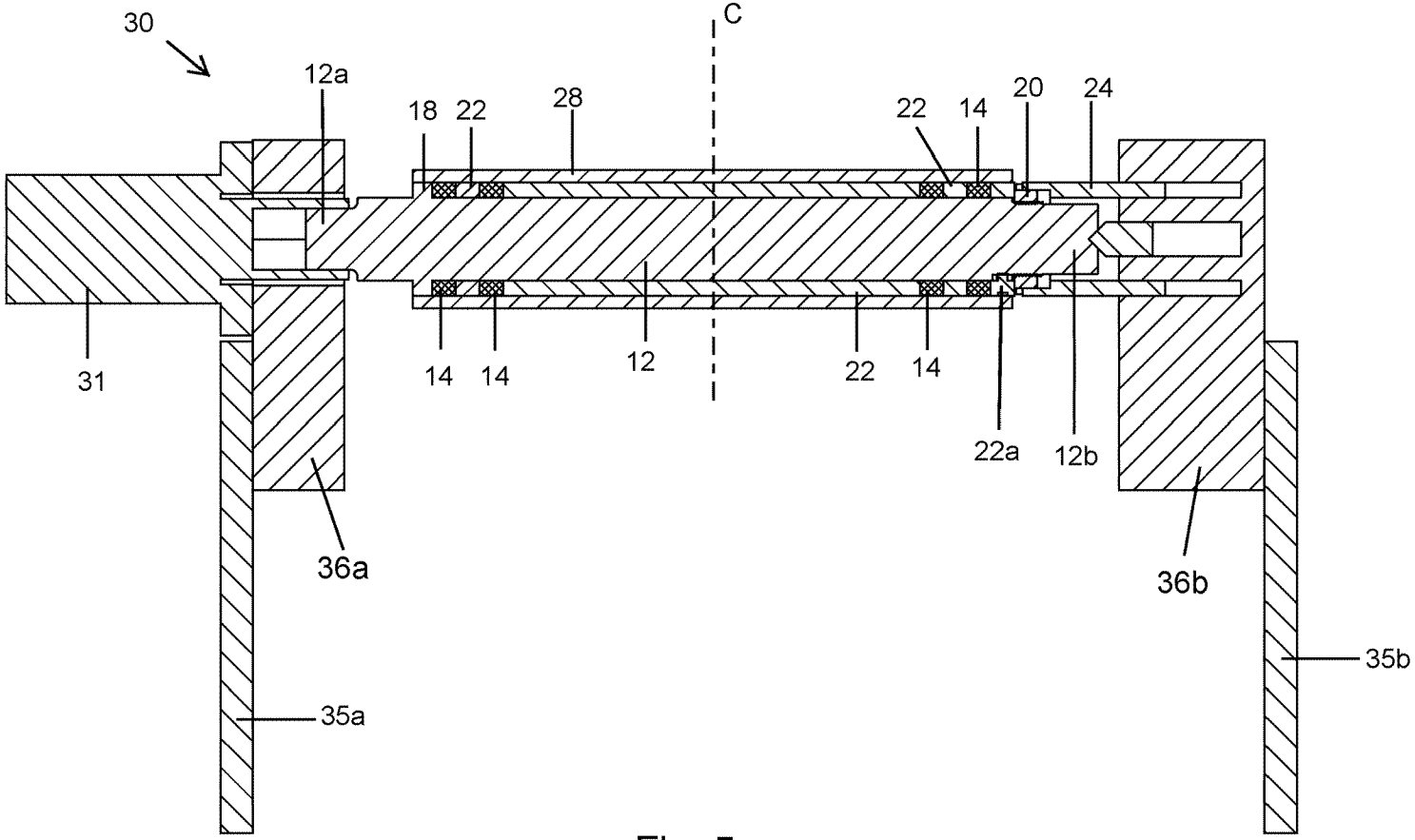
FIG. 5 shows a cross-section along the line I-I of FIG. 4 with the tool in an engaged position.

In general terms, the mandrel 10 comprises a substantially cylindrical mandrel shaft 12 extending along a mandrel shaft axis A and a plurality of expansion rings 14 that are slidably and coaxially mounted on the mandrel shaft 12. Each expansion ring 14 is radially outwardly expanded when axially compressed. The mandrel 10 also comprises a locking assembly, comprising a stop ring 18 that has an axially fixed position on the mandrel shaft 12 adjacent a first end 12*a* of the mandrel shaft 12 and a locking ring 20 that is movably mounted on the mandrel shaft 12 adjacent a second end 12*b* of the mandrel shaft 12. The expansion rings 14 are mounted between the stop ring 18 and the locking ring 20. The locking assembly has a locked position in which the locking ring 20 is positioned closer to the stop ring 18 than in an unlocked position. In the locking position of locking assembly, the expansion rings 14 are in an axially compressed and radially expanded state. In the unlocked position of the locking assembly, the expansion rings 14 are in a released state in which the axial compression and the radial expansion of the expansion rings 14 are smaller than in the locked position. The outer diameter of the expansion rings 14 is larger in the locked position than in the unlocked position. The mandrel is characterized in that locking assembly comprises a single stop ring 18 and a single locking ring 20. Additionally, the mandrel 10 includes a plurality of spacer rings 22 that are coaxially mounted on the mandrel shaft 12 in between the expansion rings 14, such that the expansion rings 14 are spatially separated from each other. The outer diameter of the spacer rings 22 is substantially equal to the outer diameter of the expansion rings 14 in the released state. The locking ring 20 and the stop ring 18 are substantially equidistant from a center plane C that is positioned perpendicular to the mandrel shaft axis A and intersects with the mandrel shaft 12. The plurality of expansion rings 14 is mounted substantially symmetrically with respect to the center plane C. The expansion rings 14 are made from plastic. The various parts of an example of such a mandrel 10 are clearly visible in FIGS. 3 and 5.

To form a printing cylinder, a printing cylinder sleeve 28 may be slid on and off the mandrel 10 when the locking ring 20 of the locking assembly is in the unlocked position.

In an embodiment, of which an example is shown in the figures, at least one of the locking ring 20 and the stop ring 18 may have an outer diameter that is substantially equal to the outer diameter of the expansion rings 14 in the released state. In the example shown in the figures, only the stop ring 18 has an outer diameter that is substantially equal to the outer diameter of the expansion rings 14. The locking ring 20 has a slightly smaller diameter. By virtue thereof, the printing cylinder sleeve 28 may be slid over the locking ring 20. The printing cylinder sleeve 28 may also internally supported by the stop ring 18.

Preferably, the outer diameter of the spacer rings 22 is substantially equal to the outer diameter of the at expansion rings 14 in the released state. By virtue thereof, the printing cylinder sleeve 28 is internally supported along substantially its entire length by the expansion rings 14 and the spacer rings 22.

By providing a plurality of expansion rings 14 on the mandrel shaft 12, various lengths of printing cylinder sleeves 28 can be easily mounted on the mandrel 10. The plurality of expansion rings 14 additionally provides more positions along the length of the printing cylinder sleeve 28 where the press fit connection between the printing cylinder sleeve 28 and the mandrel shaft 12 is effected. Such a plurality of press fit connections provides a more secure connection between the mandrel shaft 12 and the printing cylinder sleeve 28. An example of this embodiment with four expansion rings 14 is clearly visible in FIGS. 3 and 6. In the example a central spacer ring 22 has a considerable length whereas the spacer rings 22 which are positioned between the expansion rings 14 are shorter. It is clear that more or less than four expansion rings 14 are feasible also, be it that a higher number is more preferred than a lower number of expansion rings 14 in view of the improved number of press-fit connections that will be provided along the length of the printing sleeve and the increased contact and with that clamping surface when the number of expansion rings is four or higher.

A symmetrical placement of the expansion rings 14 with regard to a center plane C allows a symmetrical connection of a printing cylinder sleeve 18 to the mandrel shaft 12, preferably at least near both ends 12*a*, 12*b* thereof. Such a symmetrical connection is beneficial for the stability of the printing cylinder sleeve 18 along its entire length.

Expansion rings 14 of plastic are flexible in nature and are wear-resistant and provide by virtue of their relatively large axial length a relatively large outer and inner circumferential contact surface. Consequently, a large clamping surface both radially external as well as radially internal are provided. Such a large clamping surfaces provide a very strong press fit connection between the expansion rings 14 and the mandrel shaft 12 as well as a very strong press fit connection between the expansion rings 14 and the printing sleeve 28. It is therefore advantageous to use a plastic expansion ring that is configured to expand radially when axially compressed.

In an embodiment the expansion rings 14 may have an internal diameter that is substantially equal to an outer diameter of the mandrel shaft 12.

By providing expansion rings 14 according to this embodiment, the expansion rings 14 are substantially prevented from expanding in a radially inward direction. When being compressed in the axial direction, the expansion rings 14 are inclined to expand both radially inwardly as well as radially outwardly. However, there is no room for expansion in the radial inward direction and only very limited room for expansion in the radial outward direction. Consequently, the expansion rings 14 are locked in between the mandrel shaft 12 and the printing cylinder sleeve 28 and the internal compression stresses lead to normal forces of the expansion rings 14 being exerted on both the mandrel shaft 12 and the printing cylinder sleeve 28. These normal forces provide an increase friction between the expansion rings 14 on the one hand and the mandrel shaft 12 and the printing cylinder sleeve 28 on the other hand and, consequently, to a press fit connection or interference connection.

In an embodiment the plastic of the expansion rings 14 may be polyurethane (PU).

The use of expansion rings 14 made of polyurethane has several advantages that are most apparent when the mandrel 10 is used in conjunction with a cylindrical a printing sleeve 28 that is mounted on the mandrel 10. First of all, expansion rings 14 made of polyurethane inherently expand uniformly when subjected to axial compression. Thus, a plurality of expansion rings 14 coaxially mounted on the mandrel shaft 12 will expand uniformly under axial compression to a radially expanded state. The uniformity of the expansion also occurs when the single locking ring 20 is moved and the locking assembly is transferred from the unlocked position to the locked position. As a result, a printing cylinder sleeve 28 that is slid over the mandrel 10 will remain coaxial with the mandrel shaft axis A even in a radially expanded state of the polyurethane expansion rings 14. This is for example shown in FIGS. 5-7, which clearly show that the mandrel 10 is coaxially aligned with the printing sleeve 28. In addition, uniform expansion of the expansion rings 14 also occurs when a load, such as a printing sleeve, is resting upon one side of the expansion rings 14. Even despite an uneven weight distribution (as the printing cylinder sleeve 28 would primarily be supported by the upwardly directed parts of the expansion rings), tests have proven that the polyurethane expansion rings expand uniformly in a radial direction, centering the mandrel 10 relative to the printing sleeve. This is for example clearly visible in FIGS. 5 and 6 that show that the mandrel 10 is centered by the expansion rings 24 relative to the printing sleeve 28. Furthermore, polyurethane has a high coefficient of friction, which allows the mandrel 10 and the printing cylinder sleeve 28 to be fixedly connected by the expansion rings 14 when they are in an expanded state. The high friction coefficient prevents rotation of the printing cylinder sleeve 28 relative to the mandrel 10 even when the normal forces exerted by expansion rings 14 on the internal cylindrical surface of the printing cylinder sleeve 28 and the outer cylindrical surface of the mandrel shaft 12 are not very high. In addition, polyurethane can be polished with a relative high accuracy. Therefore, polyurethane expansion rings 14 can be made to strict tolerances. Thus printing cylinder with a very small TIR-value can be obtained which provides a higher quality printed image.

In an embodiment an end spacer ring 22*a* may be mounted on the mandrel shaft 12 between the locking ring 20 and the expansion ring 14 that is closest to the locking ring 20. The end spacer ring 22*a* may be movable along the mandrel shaft 12 in an axial direction. The end spacer ring 22*a* and the mandrel shaft 12 are configured to block rotation of the end spacer ring 22*a* relative to the mandrel shaft 12. The end spacer ring 22*a* is for example clearly shown in FIGS. 3 and 7.

Figure 7:
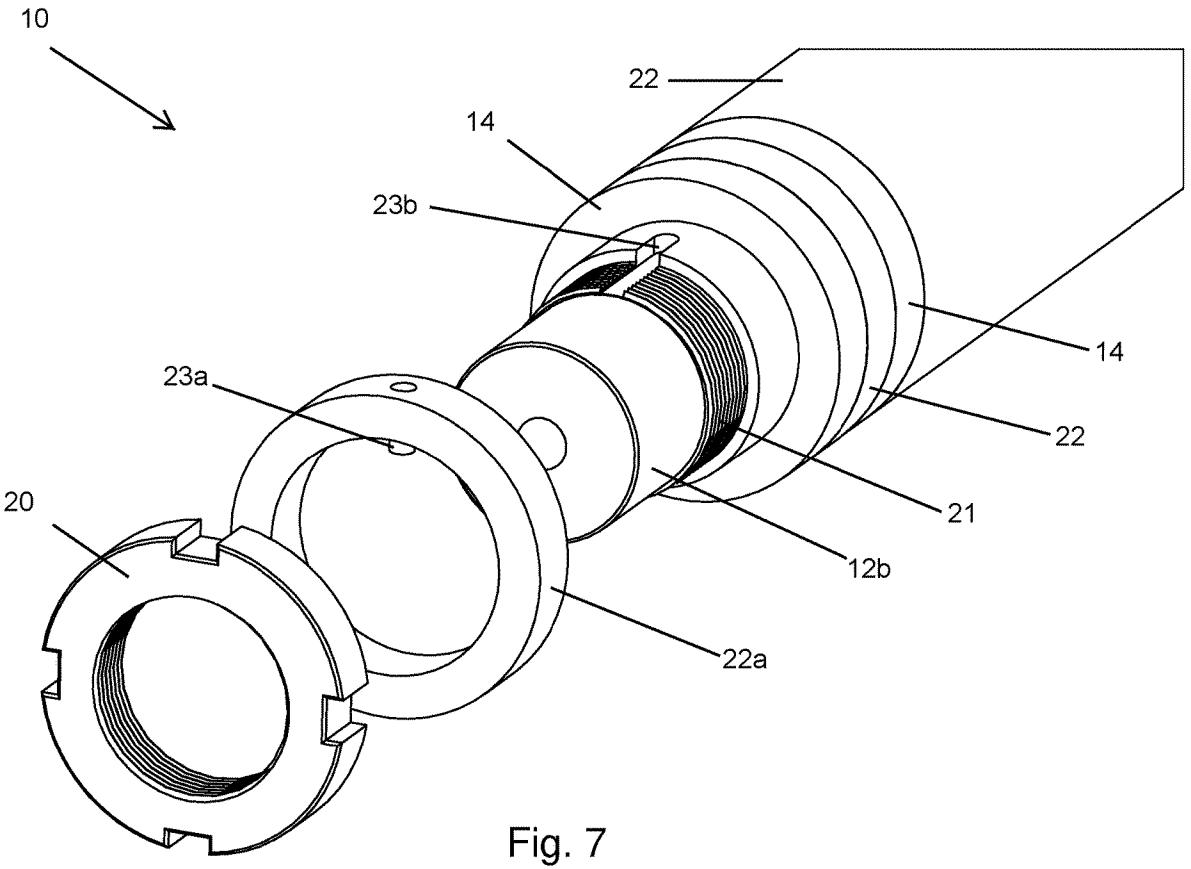
FIG. 7 shows a perspective view of a second end of an exemplary embodiment of the mandrel.

Such a non-rotatably mounted end spacer ring 22*a* is of special importance when the locking ring 20 is embodied as a nut with internal screw thread engaging external screw thread on the mandrel shaft 12 as is shown in the example of FIG. 7. The non-rotatable end spacer ring 22*a* prevents that the adjacent expansion ring 14 is deformed or damaged by the rotation of the locking ring 20 because the end spacer ring 22*a* can only move axially along the mandrel shaft 12. Consequently, the end spacer ring 22*a* is provided to prevent the expansion rings 14 and the spacer rings 22 from rotating during locking of the locking assembly. Such rotation might lead to unwanted deformation or even damage of the expansion rings 14 and, consequently to an uneven expansion of the various expansion rings 14. Uneven expansion of the expansion rings 14 might be detrimental for the TIR-value of the printing cylinder and should preferably be prevented.

In an embodiment the end spacer ring 22*a* may be provided with a key 23*a* and the mandrel shaft 12 may be provided with a groove 23*b* adjacent to the second end 12*b*. The key 23*a* is configured to engage with the groove 23*b* to block rotation of the end spacer ring 22*a* relative to the mandrel shaft 12.

An example of the key 23*a* and groove 23*b* is shown in FIG. 7. It is clearly shown that the end spacer ring 22*a* and the locking ring 20 can be moved in an axial direction, whereas rotation of the end spacer ring 22*a* relative to the mandrel shaft 12 is blocked by the key 23*a* and the groove 23*b*.

In an embodiment, of which an example is shown in FIG. 7, the second end 12*b* of the mandrel shaft 12 may be provided with an external screw thread 21. The locking ring 20 may be a nut having internal screw thread configured to cooperate with the external screw thread 21.

The locking ring 20 may be embodied as a nut that is connectable to an external screw thread 21 on the second end 12*b*. The advantage of a nut is that is may be connected both manually and mechanically to provide the locking of the locking assembly. The nut may be substantially circular, having an outer diameter that is equal to the end spacer ring 22*a*, but may also be provided in various other shapes, such as a hex or square head. FIG. 7 shows an example of the locking ring 20 provided as a nut that is configured to cooperate with the external screw thread 21.

In an embodiment the mandrel 10, the mandrel shaft 12, the locking assembly, the spacer rings 22 and/or the end spacer ring 22*a* may be made of metal. This may also comprise a combination of various metals, preferably stainless steel or aluminum.

The use of metals such as stainless steel and/or aluminum increases the rigidity and incompressibility of the mandrel during use. This is advantageous to provide a very rigid support for a printing cylinder sleeve 28. Such a rigid support prevents deformation of the printing cylinder sleeve 28 and subsequent distortion of the printed images. The locking assembly, the end spacer rings 22*a* and the mandrel shaft 12 may for example be made of stainless steel to provide a high rigidity and low deformability. The spacer rings 22 may be made of stainless steel, but may also be made of aluminum to reduce the weight of the mandrel 10. Especially the spacer rings 22 having a relatively long length may be made primarily of aluminum with stainless steel ends to reduce weight and preserve the high rigidity. Furthermore, the use of metal also allows the said parts to be precision engineered to substantially exact specifications. As a result, a more accurate mandrel 10 is provided with very small manufacturing tolerances that may co-operate with a printing cylinder sleeve 28 made entirely of metal as well and also having very small manufacturing tolerances. The combination of such a mandrel 10 with a metal printing cylinder sleeve 28 is very rigid and can have a very small TIR-value.

In an embodiment the at least one of the first and the second ends 12*a*, 12*b* may comprise a coupling that is configured to be connected to a printing apparatus.

One or both ends of the mandrel shaft 12 may be provided with a coupling to connect the mandrel 10 to a printing apparatus. The coupling may be chosen such that the mandrel 10 can be retrofitted in various types and models of printing apparatus. The coupling may be provided as an adaptable coupling that can be used in various different apparatus. An example of a mandrel 10 having the first and the second end 12*a*, 12*b* provided with a coupling is shown in FIGS. 4-7. The first end 12*a* is provided with an end that is connected to a printing apparatus 30, whereas the second end 12*b* is connectable to the printing apparatus 30 by means of a movable tapered pin 32 that is part of the printing apparatus 30.

In an elaboration of the embodiment, the coupling may include a substantially polygonal shaped end.

This may for example comprise a hex head or a square head that is connectable to a socket that is provided in a driven shaft of the printing apparatus to which the mandrel 10 may be connected.

In an alternative elaboration of the embodiment, the coupling may include a tapered cone that is receivable in a tapered socket of a driven shaft of the printing apparatus 30.

Figure 6:
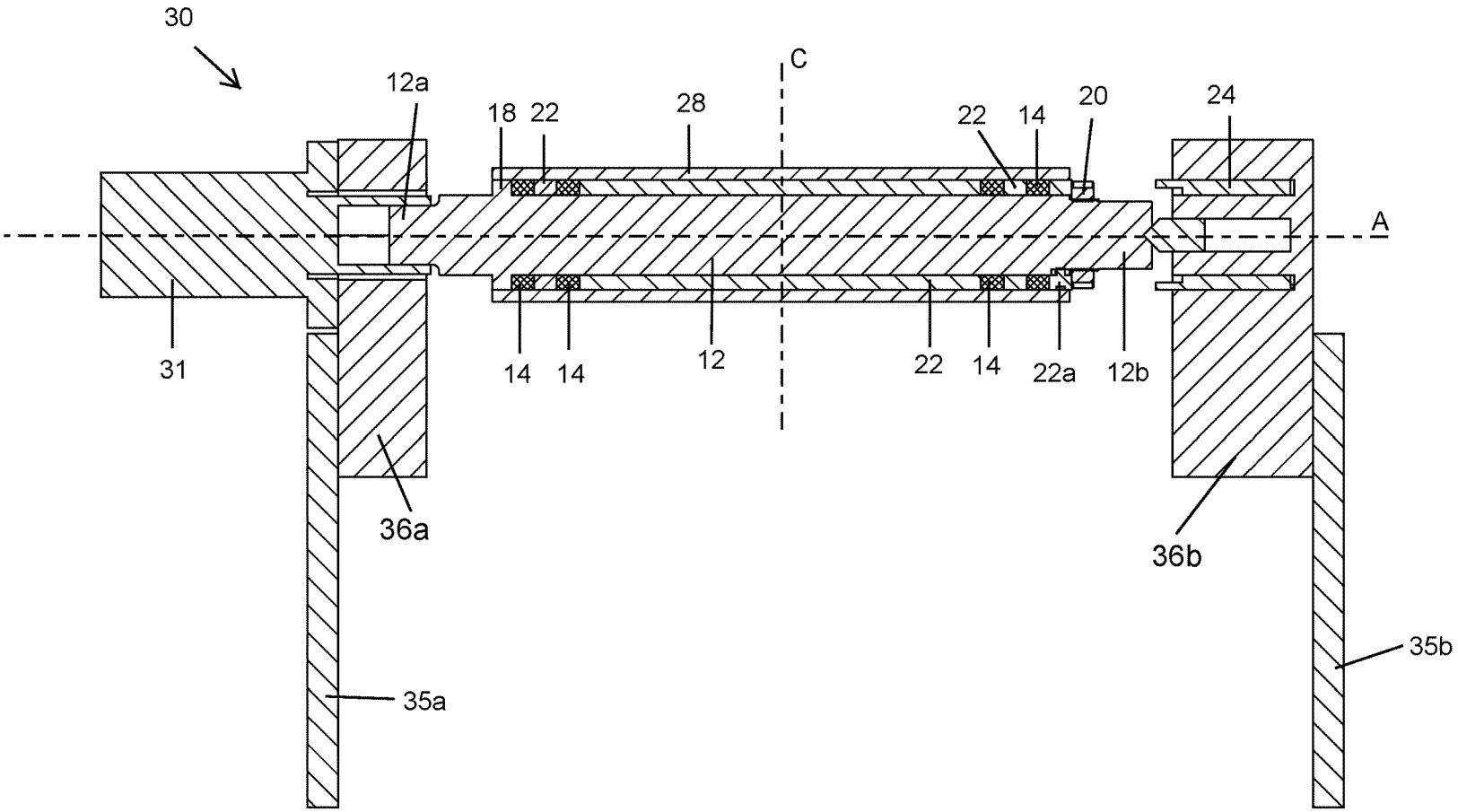
FIG. 6 shows a cross-section along the line I-I of FIG. 4 with the tool in a disengaged position.

In an embodiment the locking ring 20 may be configured to be engaged by a tool 24 for moving the locking ring 20 from the unlocked position to the locked position and from the locked to the unlocked position. An example of the tool 24 is clearly visible in FIG. 3. The tool 24 is shown in an engaged position with the locking ring 20 in FIG. 5. FIG. 6 shows the tool 24 when it is not engaged with the locking ring 20.

The invention also comprises a printing cylinder 26 for use in a printing apparatus 30. The printing cylinder 26 comprises a mandrel 10 according to the invention and a cylindrical printing sleeve 28. The cylindrical printing sleeve 28 is slidably mountable on the mandrel 10 when the locking assembly 18, 20 is in an unlocked position. When the locking assembly 18, 20 is in the locked position the expansion rings 14 are in engagement with the inner surface of the printing sleeve 28, such that the printing sleeve 28 and the mandrel 10 are fixedly connected.

An example of the connection between the expansion rings 24 and the printing sleeve 28 is shown in FIG. 6. FIG. 6 clearly depicts the expansion rings 24 in an axially compressed and radially expanded state, such that they are engaged to the printing sleeve 28 to provide a fixed connection. By using the mandrel 10 according to the invention in a printing cylinder 26, a variety of printing sleeves 28 including rigid printing sleeves 28 may be used. By mounting a printing sleeve 28 on the mandrel 10 and subsequently locking the locking assembly, the expansion rings 14 are inclined to expand to the expanded state. As a result, the printing sleeve 28 and the mandrel shaft 12 are fixedly connected. If a rigid printing sleeve 28 is used, the printing cylinder 26 will be substantially non-deformable. As a result, the printing cylinder 26 will have a very small TIR-value and substantially no distortion or degradation of the printed images occurs. The printing cylinder 26, when used with a rigid printing cylinder sleeve 28, therefore removes the disadvantage of deformation and print quality loss that is present the prior art apparatus.

In an embodiment the printing cylinder sleeve 28 is a metal printing sleeve.

Providing metal printing sleeves 28 for the printing cylinder 26 has several advantages. First of all, a metal printing sleeve 28, such as for example a printing sleeve of stainless steel or aluminum, has a relatively high rigidity and wear resistance that is not present in the printing sleeves 28 as presented in the prior art. As a result, the TIR-value of a metal printing sleeves 28 can be lower than that of existing (deformable) printing sleeves 28 intended for air mandrels. This is beneficial as a lower TIR is required for providing a higher quality printed image.

In addition, metal printing sleeves 28 have a relatively long lifetime because such sleeves 28 are not subject to aging. Deformable printing sleeves, such as known from the art, are well-known to be subjected to aging that reduces the lifetime. In addition, the manufacturing of metal printing sleeves 28 is less complicated and expensive compared to the deformable printing sleeves from the prior art. Furthermore, metal printing sleeves 28 can be manufactured with relatively high accuracy, providing highly precise printing sleeves 28 that can easily be mounted on the mandrel 10.

In an embodiment, the surface of the sleeve may include a surface structure that is configured for one of flexographic printing, offset printing, letterpress printing and rotogravure printing.

Such a surface structure may be applied by engraving either by a wet etching technique or by laser engraving.

In an alternative embodiment the printing cylinder 26 may comprise a flexible printing plate that is mounted on an outer cylindrical surface of the printing sleeve 28. The printing plate may be chosen from a group consisting of a flexographic printing plate, an offset printing plate, a letterpress printing plate, and a rotogravure printing plate.

The printing cylinder 26 can be used in various types of printing processes, such as flexographic printing, off-set printing, letterpress printing and rotogravure printing.

By providing a highly rigid printing cylinder 26 a very high quality and crisp image can be obtained with all these various printing techniques.

In embodiment, the mandrel shaft 12 may include a key and the printing cylinder sleeve 28 may include a key groove. Alternatively, the mandrel shaft 12 may include a key groove and the printing cylinder sleeve 28 may include a key. The key and the key groove may be configured to cooperate to define the rotational position of the printing cylinder sleeve 28 relative to the mandrel shaft 12 when the printing cylinder sleeve 28 is mounted on the mandrel shaft. This may be beneficial to define a rotational zero position of the sleeve 28 relative to the mandrel shaft 12, which may contribute to a quicker set up of the registering of a new printing job. Optionally, the same key and groove assembly may also be configured to define an axial stop for the printing cylinder sleeve 28, when being slid over the mandrel shaft 12. Such an axial stop function of the key and groove may define the axial position of the sleeve 28 relative to the mandrel shaft 12, which is also beneficial for registering when setting up a new printing job.

The invention also comprises a printing apparatus for printing on a substrate web W. FIGS. 1-6 show the relevant part of an example of such a printing apparatus. The various possible ink delivery assemblies nor the impression cylinder and the optional off-set cylinder are shown because that would be detrimental to the clarity of the figures and because these features are known to the skilled person in the art. The printing apparatus comprises at least one printing module 30. Normally, the printing apparatus comprises a plurality of printing modules that are arranged in line and through which a substrate web is guided to be printed. At least one of the printing modules 30 includes a printing cylinder 26 according to the invention. In an embodiment, of which an example is shown in FIGS. 1-6, the printing module 30 includes a frame 35 including a frame plate 35*a* at a drive side of the printing module and a frame plate 35*b* at an operator side of the printing module 30. On both frame plates, 35*a*, 35*b* a support block 36*a*, 36*b* is upwardly and downwardly movably mounted. The support blocks 36*a*, 36*b* are configured for supporting an end 12*a*, 12*b* of the mandrel shaft 12. The two support blocks 36*a*, 36*b* may be moved upwardly and downwardly independently from each other. For example, when a printing cylinder sleeve 28 has to be removed or placed on the mandrel 10, the support block 36*a* at the drive side of the printing module will be moved upwardly and the support block 36*b* at the operator side of the printing module will be moved downwardly. The printing cylinder 26 will then only be supported by the support block 36*a* at the drive side of the printing module. During printing, both support blocks 36*a* and 36*b* will be at the same height and will be both engaging the printing cylinder 26.

The printing cylinder 26 is configured for transferring ink to a substrate web W be it directly or via an offset cylinder. Each printing module 30 also may include a drive motor 31 or a drive transmission for rotatably driving the printing cylinder. The drive motor 31 may be a direct drive motor 31, for example, a servo motor. Alternatively, the printing apparatus may include a central drive motor which, via a drive transmission of a respective printing module 30, may be coupled to the printing cylinder 26 of the respective printing module 30. Furthermore, each printing module 30 includes an impression cylinder (not shown) that extends parallel to the printing cylinder. A substrate web is guided over the impression cylinder. The printing module 30 additionally includes an ink delivery assembly (not shown) for applying ink on the printing cylinder 26. The printing apparatus also includes an electronic controller for controlling the at least one drive motor 31. Each printing module 30 may have its own electronic module controller. These electronic module controllers will be in communication with the main electronic controller of the printing apparatus. It is also possible that the printing modules are each directly controlled by the main electronic controller of the printing apparatus. In the context of the present application, both possible configurations, i.e. a single main electronic controller or an assembly of electronic module controllers and a main controller, are considered to be covered by the feature "an electronic controller for controlling the at least one drive motor 31" of the printing apparatus.

The printing apparatus 30 has the advantages that are described in the summary to which reference is made. In the example shown in FIGS. 1-6, the drive motor 31 for the printing cylinder 26 is mounted on the support block 36*a* at the drive side of the module.

In an embodiment that includes a mandrel 10 and a tool 24, the tool 24 for engaging the locking ring 20 may be embodied as a socket of a socket wrench. Such a tool may be handled by an operator operating the printing machine.

In an alternative embodiment that includes a mandrel 10 and a tool 24, the tool 24 may be an integrated part of the printing apparatus or the printing module 30, in that it is movably connected to a frame part of the printing apparatus. Such a configuration provides the advantage that the locking assembly 18, 20 of the mandrel 10 may be automatically brought from the unlocked into the locked position and vice versa. In the example shown in the figures, the tool 24 is slideably connected to the support block 36*b* at the operator side of the printing module 30. When the tool 24 is engaging the locking ring 20 and the drive motor 31 is activated to rotate the mandrel shaft 12, the locking ring 20 will axially move along the mandrel shaft 12 so as lock or unlock the locking assembly 18, 20.

In an embodiment the tool 24 and/or the mandrel 10 may be movable to a tool engage position (see FIGS. 1 and 5), in which the locking ring 20 and the tool 24 are engaged to move the locking ring 20 from the locked position to the unlocked position and vice versa. The tool 24 and/or the mandrel 10 may be movable to a tool release position (see FIGS. 2 and 6), in which the tool 24 and the locking ring 20 are spatially separated from each other.

Several elaborations of the embodiment can be envisioned. This concerns for example a printing apparatus having an integrated tool 24 that is movably connected to the apparatus. The tool 24 can be moved to the locking ring 20 as to provide a tool engage position, in which the tool 24 can be used to move the locking ring 20 to lock or unlock the locking assembly. However, in another elaboration, the tool 24 may be fixedly connected tool 24 and the printing cylinder 26 may be movable from and towards the tool 24. Naturally, the tool 24 and the printing cylinder 26 can be both movable, which provides an increase in flexibility of the apparatus, as both may be moved to provide the tool engage and the tool release position.

In an embodiment, the drive motor 31 may be configured to drive the tool 24 and/or the mandrel 10 when the tool 24 and the mandrel 10 are in an engaged position, to move the locking assembly, in particular the locking ring 20, from an unlocked position to a locked position and vice versa.

As described above, the frame 35 may include a drive side frame plate 35*a* adjacent the drive motor 31 of the printing module 30. Additionally, the frame 35 may include an operator side frame plate 35*b* adjacent an operator side of the printing module 30. The drive side frame plate 35*a* may carry a drive side support block 36*a*. The operator side frame plate 35*b* may carry a operator side support block 36*b*. The drive side support block 36*a* and the operator side support block 36*b* are configured to engage and support a mandrel shaft end 12*a*, 12*b* of the mandrel shaft 12 and are independently moveable relative to each other in an upward and downward direction.

In a first embodiment (not shown in the figures), the second end 12*b* of the mandrel shaft 12 may be connected to the drive side support block 36*a*. The first end 12*a* of the mandrel shaft 12 may be connectable to the operator side support block 36*b*. The tool 24 may be moveably connected to the drive side support block 36*a*.

This embodiment has the advantage that the actuator for effecting the moveability of the tool 24 for bringing the tool in the engaging and the non-engaging position is provided at the drive side of the printing module 30 thus keeping the operator side as clean as possible. This is advantageous for the accessibility of printing area by the operator and is beneficial for the ease with which the printing cylinder sleeve 28 can be exchanged.

In a second, alternative embodiment, of which an example is shown in the figures, the first end 12*a* of the mandrel shaft 12 is connected to the drive side support block 36*a* and wherein the second end 12*b* of the mandrel shaft 12 is connectable to the operator side support block 36*b*.

This allows an operator access to the locking ring 20 to lock or unlock said locking ring 20 with a hand tool such as a wrench. Such an embodiment is relatively simple. In fact, many existing machines may be converted to this embodiment, just by replacing the air mandrels with a new mandrel 10 according to an embodiment of the invention.

In further elaboration of this embodiment, which is especially feasible for new machines, the tool 24 may be moveably connected to operator side support block 36*b*.

In that elaboration, the locking ring 20 may be operated using the tool 24 that is integrated in the printing apparatus 30. An example of this embodiment of the invention is shown in FIGS. 1-7.

The mandrel shaft 12 can be connected to the frame in various positions and using several connection means. In this particular embodiment the second end 12*b* of the mandrel shaft 12, on which the locking ring 20 is mounted, and the tool 24 are connected adjacent the drive side of the frame 35. Mounting both the second end 12*b* and the tool 24 to one side of the frame makes it relatively easy to engage the tool 24 and the second end 12*b*.

In an embodiment the tool 24 may be connected to the frame 35 adjacent the operator side thereof.

In this further elaboration, automated locking and unlocking is possible by coordinated engaging and disengaging the locking ring 20 with the tool 24 and driving the drive motor 31 to move the locking ring 20 and with that the locking assembly 18, 20 from a locked position to an unlocked position and vice versa.

In an embodiment, the printing apparatus may be of the rotary flexographic printing type. In such a flexographic printing apparatus, the printing cylinder 26 abuts against the impression cylinder along a printing contact line. The substrate web is guided between the printing cylinder 26 and the impression cylinder. The ink delivery assembly (not shown) comprises an ink reservoir (not shown) configured for holding ink and an anilox cylinder (not shown) that abuts against the printing cylinder 26 and that is configured for transferring ink from the ink reservoir to the printing cylinder 26.

In an embodiment, the printing apparatus may be of the off-set lithography printing type. The ink delivery assembly may comprise an ink reservoir configured for holding ink and ink cylinders for transferring ink from the ink reservoir to the printing cylinder 26. The printing apparatus additionally may comprise a water supply assembly (not shown) including a water reservoir and at least one water cylinder for transferring water to the printing cylinder 26. Furthermore, the printing apparatus 30 may comprise an off-set cylinder (not shown) that is positioned between the printing cylinder 26 and the impression cylinder and abuts both the printing cylinder 26 and the impression cylinder. The web substrate is guided between the impression cylinder 26 and the off-set cylinder. The off-set cylinder is configured for transferring an ink image supplied by the printing cylinder 26 to the web substrate.

The invention also comprises a method for printing using a printing apparatus. The method comprises providing a printing apparatus according to the invention. In addition, the method comprises bringing the locking assembly to an unlocked position and sliding the printing sleeve 28 over the mandrel 10. Furthermore, it comprises locking the locking assembly 18, 20, therewith expanding the expansion rings 14 so as to form a press fit connection between an outer surface of the expansion rings 14 and the inner surface of the printing cylinder sleeve 28. Simultaneously, a press fit connection is formed between an inner surface of the expansion rings 14 and an outer surface of the mandrel shaft 12. Thus a fixed connecting between the printing cylinder sleeve 28 and the mandrel 10 is formed. The method further comprises providing web substrate for printing images on said web substrate using said printing sleeve 28.

The method provides a quick and reliable exchange of printing cylinder sleeves 28 in a printing apparatus using the mandrel 10 according to the invention.

Please note that the printing cylinder claimed in claims 15-16, i.e. the combination of the mandrel according to the invention and a cylindrical sleeve also is directed to a sleeve type impression cylinder and a sleeve type off-set cylinder also known as blanket cylinder. That is, the wording "printing cylinder" should not be construed solely as being directed to the cylinder that is in contact with the substrate web and that presses against the impression cylinder and that carries the image to be printed. The wording "printing cylinder" in this context also is intended to cover any type of sleeve cylinder assembly that is used in a printing apparatus and that includes a mandrel according to the invention and a sleeve, be it blanket cylinder sleeve, a impression cylinder sleeve or a printing cylinder sleeve that carries the image to be printed.

The various embodiments which are described above may be used independently from one another or may be combined with one another in any combination. The reference numbers used in the detailed description and the claims do not limit the description of the embodiments nor do they limit the claims. The reference numbers are solely used to clarify.

LEGEND

10—mandrel
12—mandrel shaft
12*a*—first mandrel shaft end
12*b*—second mandrel shaft end
14—expansion ring
18—stop ring
20—locking ring
21—external screw thread
22—spacer ring
22*a*—end spacer ring
23*a*—key
23*b*—groove
24—tool
28—printing cylinder sleeve
30—printing module
31—drive motor
35*a*—drive side frame plate
35*b*—operator side frame plate
36*a*—drive side support block
36*b*—operator side support block
A—mandrel shaft axis
C—center plane

The invention claimed is:

1. A mandrel for use in a printing apparatus, the mandrel comprising:

a substantially cylindrical mandrel shaft extending along a mandrel shaft axis;

a plurality of expansion rings slidably and coaxially mounted on the mandrel shaft, wherein the each expansion ring is radially outwardly expanded when axially compressed;

a locking assembly, comprising:

a stop ring that has an axially fixed position on the mandrel shaft adjacent a first end of the mandrel shaft; and a locking ring that is movably mounted on the mandrel shaft adjacent a second end of the mandrel shaft, wherein the expansion rings are mounted between the stop ring and the locking ring, and wherein the locking assembly has a locked position in which the locking ring is positioned closer to the stop ring than in an unlocked position, wherein in the locked position the expansion rings are in an axially compressed and radially expanded state, and wherein in the unlocked position the expansion rings are in a released state in which the axial compression and the radial expansion of the expansion rings are smaller than in the locked position, wherein the outer diameter of the expansion rings is larger in the locked position than in the unlocked position of the locking assembly, and wherein the locking assembly comprises a single stop ring and a single locking ring, and wherein the mandrel additionally includes:

a plurality of spacer rings that are coaxially mounted on the mandrel shaft in between the expansion rings, such that the expansion rings are spatially separated from each other, wherein the outer diameter of the spacer rings is substantially equal to the outer diameter of the expansion rings in the released state, wherein the locking ring and the stop ring are substantially equidistant from a center plane that is positioned perpendicular to the mandrel shaft axis and intersects with the mandrel shaft, wherein the plurality of expansion rings is mounted substantially symmetrically with respect to the center plane, and wherein the expansion rings are made from plastic.

2. The mandrel according to claim 1, wherein at least one of the locking ring and the stop ring have an outer diameter that is substantially equal to the outer diameter of the expansion rings in the released state.

3. The mandrel according to claim 1, wherein the expansion rings have an internal diameter that is substantially equal to an outer diameter of the mandrel shaft.

4. The mandrel according to claim 1, wherein the plastic is polyurethane.

5. The mandrel according to claim 1, wherein an end spacer ring is mounted on the mandrel shaft between the locking ring and the expansion ring that is closest to the locking ring, wherein the end spacer ring is movable along the mandrel shaft in an axial direction, and wherein the end spacer ring and the mandrel shaft are configured to block rotation of the end spacer ring relative to the mandrel shaft.

6. The mandrel according to claim 5, wherein the end spacer ring is provided with a key, and wherein the mandrel shaft is provided with a groove adjacent to the second end, wherein the key is configured to engage with the groove to block rotation of the end spacer ring relative to the mandrel shaft.

7. The mandrel according to claim 1, wherein the second end of the mandrel shaft is provided with an external screw thread and wherein the locking ring is a nut having internal screw thread configured to cooperate with the external screw thread.

8. The mandrel according to claim 1, wherein the mandrel and/or the mandrel shaft and/or the locking assembly and/or the spacer rings and/or the end spacer ring consist of metal and/or a combination of various metals.

9. The mandrel according to claim 1, wherein the at least one of the first and the second ends comprises a coupling that is configured to be connected to a printing apparatus.

10. The mandrel according to claim 9, wherein the coupling includes a substantially polygonal shaped end or a tapered cone shaped end.

11. The mandrel according to claim 1, wherein the locking ring is configured to be engaged by a tool for moving the locking ring from the unlocked position to the locked position and from the locked to the unlocked position.

12. A printing cylinder for use in a printing apparatus, comprising:

the mandrel according to claim 1; and a cylindrical printing cylinder sleeve that is slidably mountable on the mandrel when the locking assembly is in an unlocked position, and wherein the plurality of spaced apart expansion rings is in engagement with the inner surface of the printing sleeve when the locking assembly is in the locked position such that a press fit connection between the expansion rings and the sleeve is provided at multiple points along the axial length of the sleeve and such that the printing sleeve and the mandrel are fixedly connected.

13. The printing cylinder according to claim 12, wherein the printing cylinder sleeve is a metal printing sleeve.

14. The printing cylinder according to claim 12, wherein the surface of the sleeve includes a surface structure that is configured for one of flexographic printing, offset printing, letterpress printing and rotogravure printing.

15. The printing cylinder according to claim 12, including a flexible printing plate that is mounted on an outer cylindrical surface of the printing cylinder sleeve, wherein the printing plate is chosen from a group consisting of a flexographic printing plate, an offset printing plate, a letterpress printing plate, and a rotogravure printing plate.

16. The printing cylinder according to claim 12, wherein the mandrel shaft includes a key and the printing cylinder sleeve includes a key groove, or alternatively, wherein the mandrel shaft includes a key groove and the printing cylinder sleeve includes a key, wherein the key and the key groove are configured to cooperate to define the rotational position of the printing cylinder sleeve relative to the mandrel shaft when the printing cylinder sleeve is mounted on the mandrel shaft.

17. A printing apparatus for printing on a substrate web, the printing apparatus comprising at least one printing module that includes:

a printing cylinder according to claim 12 configured for transferring ink to a substrate web;

a drive motor or a drive transmission for rotatably driving the printing cylinder;

an impression cylinder that extends parallel to the printing cylinder and over which the substrate web is guided; and an ink delivery assembly for applying ink on the printing cylinder wherein the printing apparatus includes an electronic controller for controlling the at least one drive motor.

18. The printing apparatus according to claim 17, wherein the locking ring is configured to be engaged by a tool for moving the locking ring from the unlocked position to the locked position and from the locked to the unlocked position, and wherein the tool for engaging the locking ring is embodied as a socket of a socket wrench.

19. The printing apparatus according to claim 17, wherein the locking ring is configured to be engaged by a tool for moving the locking ring from the unlocked position to the locked position and from the locked to the unlocked position, and wherein the tool is an integrated part of the printing apparatus in that it is movably connected to a frame of the printing module.

20. The printing apparatus according to claim 19, wherein the tool and/or the mandrel are movable to a tool engage position, in which the locking ring and the tool are engaged to move the locking ring from the locked position to the unlocked position and vice versa, and wherein the tool and/or the mandrel are movable to a tool release position, in which the tool and the locking ring are spatially separated from each other.

21. The printing apparatus according to claim 20, wherein the drive motor is configured to drive the tool and/or the mandrel when the tool and the mandrel are in an engaged position, to move the locking assembly from an unlocked position to a locked position and vice versa.

22. The printing apparatus according to claim 17, comprising a support frame, having a drive side frame plate adjacent the drive motor of the printing module and having an operator side frame plate adjacent an operator side of the printing module, wherein the drive side frame plate carries a drive side support block and wherein the operator side frame plate carries a operator side support block, the drive side support block and the operator side support block are configured to engage and support a said mandrel shaft end of the mandrel shaft and are independently moveable relative to each other in an upward and downward direction.

23. The printing apparatus according to claim 22, wherein the second end of the mandrel shaft is connected to the drive side support block and wherein the first end of the mandrel shaft is connectable to the operator side support block, wherein the tool is moveably connected to the drive side support block.

24. The printing apparatus according to claim 22, wherein the first end of the mandrel shaft is connected to the drive side support block and wherein the second end of the mandrel shaft is connectable to the operator side support block.

25. The printing apparatus according to claim 24, wherein the tool is moveably connected to operator side support block.

26. The printing apparatus according to claim 17, wherein the printing apparatus is of the rotary flexographic printing type wherein the printing cylinder abuts against the impression cylinder along a printing contact line, wherein the substrate web is guided between the printing cylinder and the impression cylinder, and wherein the ink delivery assembly comprises:

an ink reservoir configured for holding ink; and an anilox cylinder that abuts against the printing cylinder and is configured for transferring ink from the ink reservoir to the printing cylinder.

27. The printing apparatus according to claim 17, wherein the printing apparatus is of the off-set lithography printing type and wherein the ink delivery assembly comprises:

an ink reservoir configured for holding ink; and ink cylinders for transferring ink from the ink reservoir to the printing cylinder, and wherein the apparatus additionally comprises:

a water supply assembly including:

a water reservoir; and at least one water cylinder for transferring water to the printing cylinder; and an off-set cylinder that is positioned between the printing cylinder and the impression cylinder, wherein the off-set cylinder abuts to both the printing cylinder and the impression cylinder, wherein the web substrate is guided between the impression cylinder and the off-set cylinder, and wherein the off-set cylinder is configured to transferring an ink image supplied by the printing cylinder to the web substrate.

28. A method for printing using a printing apparatus, comprising:

providing the printing apparatus according to claim 17;

bringing the locking assembly to an unlocked position;

sliding the printing cylinder sleeve over the mandrel;

locking the locking assembly, therewith expanding the expansion rings so as to form a press fit connection between an outer surface of the expansion rings and the inner surface of the printing cylinder sleeve as well as to form a press fit connection between an inner surface of the expansion rings and an outer surface of the mandrel shaft, thus forming a fixed connecting between the printing cylinder sleeve and the mandrel; and providing a web substrate and printing images on said web substrate using said printing sleeve.

* * * * *